United States Patent [19]

Colvin

[11] 4,329,740

[45] May 11, 1982

[54] BAR LIGHT

[76] Inventor: Darrell W. Colvin, 1140 S. 101 Est Ave. #50, Tulsa, Okla. 74128

[21] Appl. No.: 169,199

[22] Filed: Jul. 15, 1980

[51] Int. Cl.[3] ..... F21V 33/00

[52] U.S. Cl. ..... 362/184; 362/186; 362/205; 362/231; 362/251; 362/414

[58] Field of Search ..... 362/184, 186, 205, 231, 362/251, 414

[56] References Cited

U.S. PATENT DOCUMENTS 2,491,914 12/1949 Anderson ..... 362/184

*Primary Examiner*—Stephen J. Lechert, Jr.

*Attorney, Agent, or Firm*—Blair, Brown & Kreten

[57] ABSTRACT

A bar light including a base and a dome-shaped cap mounted on said base for vertical reciprocating movement between a lower position in which the cap is releasably retained and an upper position into which the cap is yieldingly urged together with a circuit including a two position switch, a battery and a pair of lamps of different colors for illuminating the cap, the cap being arranged to move the switch into one position in the lower position of the cap for energizing one of the lamps and to permit the switch to move into the other position in the upper position of the cap for energizing the other of the lamps.

10 Claims, 4 Drawing Figures

FIG. 1
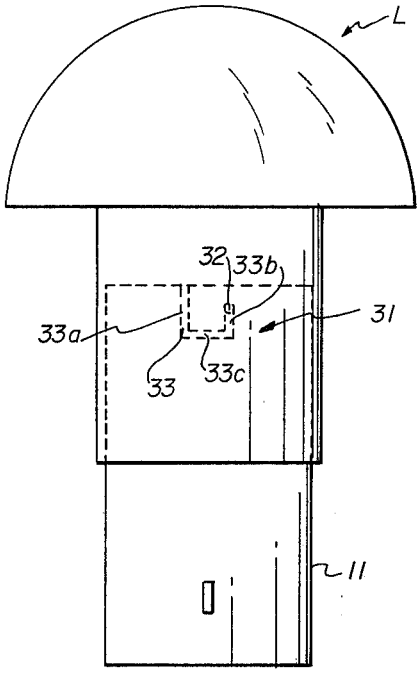
FIG. 2
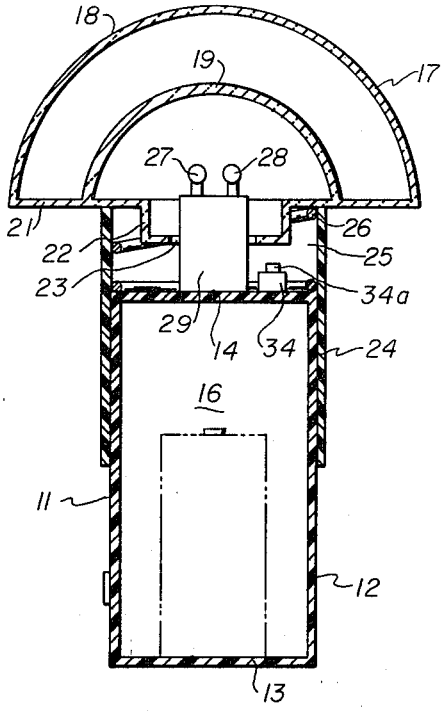
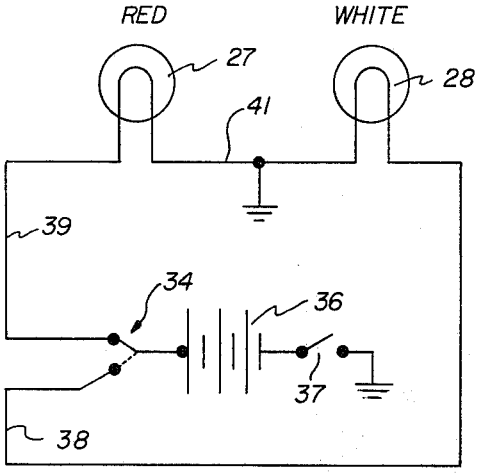
FIG. 3
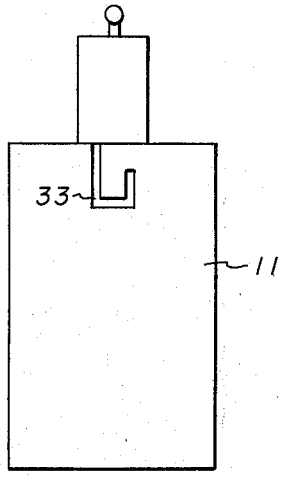
FIG. 4

BAR LIGHT

BACKGROUND OF THE INVENTION

In food or beverage service facilities which depend on personal service by waiters, waitresses or the like, one of the most aggravating inconveniences is the inability to obtain prompt service when such is needed. This situation is particularly aggravated under crowded conditions and/or where the service personnel is limited in number. In establishments where potables such as alcoholic beverages are consumed, inability to obtain a refill of one's drink is quite annoying and frustrating for the typical patron and, on occasion, can lead to arguments and other disturbances. In the typical cocktail lounge or similar establishment, the generally darkened conditions, the densely packed patrons and the high noise level all combine to make it difficult to attract the attention of the service personnel such as waitresses so that the patron is unable to obtain the desired service in replenishing consumed beverages.

OBJECTS AND SUMMARY OF THE INVENTION

Accordingly, a primary object of this invention is to provide a new and novel device for attracting the attention of service personnel in food and beverage dispensing establishments.

Another object of this invention is to provide a new and novel device for attracting the attention of waitresses and the like in dimly lit establishments so that a patron needing service may be quickly identified by the waitress.

A further object of this invention is to provide a new and novel device which may be easily operated by a patron for selectively indicating a need for service or that no service is required in establishments such as cocktail lounges, bars and the like.

Still another object of this invention is to provide a new and novel illuminating device for use by patrons in cocktail lounges, bars and the like which is simple and inexpensive in construction, which provides a light signal to service personnel and which is capable of long use without breakdown.

The objects stated above and other related objects of the invention are accomplished by the provision of a tubular base on which a dome-shaped cap is detachably mounted by means of a sleeve telescopingly engagable with the base for vertical reciprocating movement of the cap between a lower and upper position. Means are provided for yieldingly urging the cap upwardly into the upper position and means are provided for releasably retaining the cap on the base to permit the cap to be moved downwardly from the upper position into the lower position against the urging means. A pair of lamps of different colors are provided for illuminating the cap and circuit means includingr a switch operatively associated with the cap are provided for selectively and alternately connecting the lamps to a battery within the base. A downward movememnt of the cap from the upper position into the lower position moves the switch into one position for connecting one of the lamps to th battery so that a lamp of one color is illuminated. A successive downward movement of the cap from the upper to the lower position moves the switch into a second position for connecting the other of the lamps to the battery to illuminate the cap with the color of the other lamp.

The above-mentioned and other features and objects of the present invention will become more apparent by reference to the following description taken in conjunction with the accompanying drawings wherein like reference numerals denote like elements.

BRIEF DESCRIPTION OF THE DRAWINGS

FIG. 1 is an elevational view of the bar light of the invention;

FIG. 2 is a sectional view taken substantially along lines 2—2 of FIG. 1;

FIG. 3 is a schematic circuit diagram of the electrical circuit incorporated in the bar light of FIG. 1; and FIG. 4 is an elevational view of a portion of the bar light of FIG 1.

DESCRIPTION OF THE PREFERRED EMBODIMENT

Referring now to the drawings and to FIG. 1 in particular there is shown a bar light constructed in accordance with the invention and designated generally by the letter L. The bar light L includes a base 11 preferably in the form of a tubular member having a side wall 12, a bottom wall 13, and a top wall 14 defining an interior 16 as shown best in FIG. 2.

The bar light L includes an illuminating cap preferably of dome-shaped configuration and formed of translucent or clear plastic material. As shown best in FIG. 2, the cap 17 includes a pair of concentric, spaced-apart, dome-like walls 18, 19 interconnected at their lower edges by a plate 21 as shown in FIG. 2, the plate 21 includes a cup-shaped central portion 22 having a central opening 23.

Means are provided for detachably mounting the cap 17 for vertical reciprocating movement on the base or tubular member 11. More specifically, a downwardly depending sleeve 24 is provided on the cap 17 and the sleeve 24 may be formed of a suitable plastic material or the like. The sleeve 24 is suitably secured to the cap 17 in axial alignment with the opening 23 in the plate central portion 22 and includes an interior 25 for accommodating the tubular member side wall 12 in telescoping relationship therewith.

The cap 17 is arranged for vertical reciprocating movement from the upper position of FIG. 1 downwardly in the direction of the arrow I by manually depressing the dome 17. Means are provided for yieldingly urging the cap upwardly into the upper position of FIG. 1 which, in the illustrated embodiment, include a coil spring 26 disposed within the sleeve interior 35 between the tubular member upper wall 14 and the plate 21 as shown best in FIG. 2. A pair of lamps 27, 28 of different colors are provided on the bar light L, the lamps 27, 28 being preferably of red and white colors respectively and suitably mounted in a socket 29 supported on the tubular member upper wall 14 so as to illuminate the cap 17.

Means are provided for releasably retaining the cap on the tubular member on base 11 to permit the cap 17 to be moved downwardly from the upper position of FIGS. 1, 2 against the urging force of the spring 26. More specifically, a bayonet connection designated in FIG. 1 by the reference numberal 31 is provided on the tubular wall member 12 and sleeve 24. In the preferred embodiment, the bayonet connection 31 includes a pin 32 mounted on the inner wall of the sleeve 24 so as to extend radially inward for sliding engagement within a substantially U-shape slot 33 provided on the tubular member side wall 12 and including vertical portions 33*a*, 33*b* and a horizontal portion 33*c* as shown best in FIGS. 1, 4.

The cap 17 is detachably mounted on the base 11 by aligning the pin 32 with the slot portion 33*a* and sliding the sleeve 24 downwardly on the base 11 until the pin 32 reaches the bottom of the slot portion 33*a*. The sleeve 24 is then rotated to move the pin 32 along the horizontal slot portion 33*c* into the bottom of slot portion 33*b*. The cap 17 is then released permitting it to return to the upper position of FIG. 2 under the urging force of spring 26 until the pin 32 reaches the top of slot portion 33*b*. The cap 17 can now be depressed and released at will.

Circuit means are provided in the bar light L as shown best in FIG. 3 which include a switch 34 operatively associated with the cap 17. The switch 34 is preferably a two position rotary step switch of conventional construction having a spring load, actuating button 34*a* and is preferably mounted on the upper wall 14 of the base 11 for engagement of the button 34*a* by the plate central portion 23.

The circuit of FIG. 3 includes a source of electric power such as a battery 36 preferably disposed in the interior 16 of the base 11, the negative terminal of which is grounded through an on-off switch 37. The positive terminal of battery 36 connected to the moveable contact of switch 34 so that in the broken line position of the movable contact, power is applied through conductor 38 to one side of lamp 28. In the solid line position of the movable contact, power supplied to the lamp 27 through conductor 39. The lamps 27, 28 are connected in series by means of conductor 41 which is grounded as shown so that in the broken and solid line positions of the movable contact energization of lamps 27, 28 respectively is obtained.

In the operation of the invention, when the cap 17 is in the uppermost position shown in broken lines in FIG. 1, the pin 32 is disposed within the upper end of the slot portion 33*b* as described above. At this time, if the on-off switch 37 is closed either lamp 27 or 28 is illuminated in accordance with the position of the movable contact of switch 34. For instance, in the solid line position of the movable contact the red lamp 27 is energized indicating that the patron does not require service. When the patron wishes to attract attention of the waitress for service, the cap 17 is depressed manually downward so that the plate central portion 23 engages and depresses the button 34*a* moving the switch movable contact into the broken line position. At this time, white lamp 28 is energized alerting the waitress. After the potables are served, the cap 17 is again depressed and the switch movable contact moves again to the solid line position for illumination of the red lamp 27.

Having thus described the preferred embodiment of the invention it should be understood that numerous structural modifications and adaptation may be resorted to without departing from the spirit of the invention.

What is claimed is:

1. A bar light for signaling waitresses and the like comprising, in combination, a base an illuminating cap, means for detachably and telescopically mounting said cap on said base for vertical reciprocating movement between an upper position and a lower position, means for yieldingly urging said cap upwardly into said upper position, a pair of lamps of different colors mounted on said base for illuminating said cap, a source of electric power in said base, circuit means including a switch operatively associated with said cap for connecting said pair of lamps selectively and alternatingly to said source of power, said switch being movable into one position upon a second movement of said cap downwardly from said upper position into said lower position for connecting the other of said lamps to said source of power wherein said switch is a two position rotary step switch of the pushbutton type and wherein said cap includes a bottom plate having a cup-shaped central portion provided with a central opening with a bulb supporting socket extending therethrough and supported on the upper wall of said base, said step switch being disposed on an upper wall of said base with said pushbutton being arranged by engagement by said bottom plate central portion during the downward movement of said cap whereby said circuit means are isolated for contamination or the like by their exclusion from the environment, said circuit means substantially disposed in said base.

2. A bar light in accordance with claim 1 wherein said cap is of dome-shaped configuration.

3. A bar light in accordance with claim 2 wherein said means for detachably mounting said cap on said base comprises a downwardly depending sleeve on the underside of said cap and wherein said base comprises a tubular member having an interior, said sleeve being arranged in telescoping relationship with said tubular member for said vertically reciprocating movement of said cap between said upper and lower positions.

4. A bar light in accordance with claim 3 wherein said source of electric power comprises a battery disposed in said tubular member interior.

5. A bar light in accordance with claim 4 wherein said means for yieldingly urging said cap upwardly into said upper position comprises a spring disposed within the interior of said sleeve between said tubular member and said cap and wherein said detachable mounting means includes means for limiting the upward movement of said cap to said upper position.

6. A bar light in accordance with claim 5 wherein said switch is movable into said one position by said first downward movement of said cap into said lower position and said switch being movable into said another position by said second downward movement of said cap into said lower position.

7. A bar light in accordance with claim 6 wherein said means for detachably mounting said cap on said base comprises a bayonet connection between said tubular member and said sleeve, said bayonet connection including an inwardly directed pin on the inner wall of said sleeve and a substantially U-shaped slot in the outer wall of said base for slidably accommodating said pin in the assembled position of said sleeve on said base.

8. A bar light in accordance with claim 7 wherein said circuit means includes an on-off switch for connecting and disconnecting said battery from said pair of lamps.

9. A bar light in accordance with claim 8 wherein said dome-shaped cap is of plastic material and wherein one said lamps is of a red color and the other of said lamps is of a white color.

10. The device of claim 9 wherein said cap further includes a pair of concentric domes interconnected by said bottom plate, said bottom plate and outermost dome meeting beyond the outside area of said sleeve.

* * * * *